US007452064B2

(12) United States Patent
Katada

(10) Patent No.: US 7,452,064 B2
(45) Date of Patent: Nov. 18, 2008

(54) INK TANK AND INK-JET RECORDING APPARATUS

(75) Inventor: Masahito Katada, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 427 days.

(21) Appl. No.: 11/374,105

(22) Filed: Mar. 14, 2006

(65) Prior Publication Data

US 2006/0221151 A1 Oct. 5, 2006

(30) Foreign Application Priority Data

Mar. 30, 2005 (JP) ..... 2005-099469

(51) Int. Cl.
*B41J 2/175* (2006.01)

(52) U.S. Cl. ..... 347/86; 347/85

(58) Field of Classification Search ..... 347/84, 347/85, 86; 399/237, 254; 222/1
See application file for complete search history.

(56) References Cited

U.S. PATENT DOCUMENTS 4,011,835 A * 3/1977 Lewis ..... 399/254
5,407,097 A * 4/1995 Harpold ..... 222/1
2005/0053398 A1 * 3/2005 Kim et al. ..... 399/237

FOREIGN PATENT DOCUMENTS

JP 5-330076 A 12/1993

* cited by examiner

*Primary Examiner*—Stephen D Meier
*Assistant Examiner*—Carlos A Martinez, Jr.
(74) *Attorney, Agent, or Firm*—Birch, Stewart, Kolasch & Birch, LLP

(57) ABSTRACT

An ink cartridge is provided with a storage chamber storing ink and an ink absorbent chamber containing an ink absorbent that absorbs the ink from the storage chamber through an interconnection slot. An ejection opening is formed through the ink absorbent chamber to supply the ink to a recording head. A residual ink ejecting mechanism is built in the storage chamber, wherein a liquid send-out member is usually locked in a standby position by a lock member. When an ink run-out sensor detects that the ink is almost used up, an unlock device is activated to unlock the residual ink ejecting mechanism. Then the liquid send-out member pushes out the ink remaining on a bottom of the storage chamber toward the ejection opening, according to a force of a spring.

12 Claims, 5 Drawing Sheets

INK TANK AND INK-JET RECORDING APPARATUS

FIELD OF THE INVENTION

The present invention relates to an ink tank containing ink to be supplied to an ink-jet type recording head, and an ink-jet recording apparatus using the ink tank.

BACKGROUND OF THE INVENTION

An ink-jet recording apparatus has been known, which has a recording head for discharging ink as droplets onto a recording paper to print an image. The ink-jet recording apparatus is provided with at least an ink tank containing ink, to supply the ink from the ink tank to the recording head. The ink tank is provided with an ink chamber containing the ink, and an ink outlet for feeding the ink from the ink chamber out of the ink tank. The ink outlet consists of an ejection opening formed through a bottom wall of the ink chamber and an ejection tube connected to the ejection opening.

Because the ink is a consumable material, the ink tank is often formed as a cartridge that is removably attached to the ink-jet recording apparatus, so as to make it easy to supplement the ink-jet recording apparatus with the ink. Such a cartridge type ink tank, hereinafter called the ink cartridge, is replaced with another that is fully filled with the ink, when the ink contained in the ink cartridge is used up.

In order to notify the user of necessity to replace the ink cartridge, the ink-jet recording apparatus is provided with an ink run-out sensor for checking if the ink in the ink tank is used up. An example of such an ink run-out sensor is a photo sensor that detects the residual amount of the ink optically.

However, in many conventional cases, the ink remains a little in the ink cartridge even when the ink run-out sensor detects that the ink is used up. For the benefit of the user, it is desirable to reduce the residual ink in the used-up ink tank as much as possible. Various prior arts for reducing the final amount of residual ink have been suggested. For example, Japanese Laid-open Patent Application No. 1993-330076 discloses an ink cartridge having an ink chamber whose size is reduced from the top to the bottom so as to have a slope down to an ejection opening formed through the bottom wall. Thereby, the ink is let flow into the ejection opening.

Although the final amount of residual ink is reduced, this solution has a problem that the capacity of the ink chamber is reduced.

SUMMARY OF THE INVENTION

In view of the foregoing, a primary object of the present invention is to provide an ink tank that reduces the final amount of residual ink without reducing its ink holding capacity.

Another object of the present invention is to provide an ink-jet recording apparatus for use with the ink tank of the present invention.

To achieve the above object, the present invention suggests an ink tank for supplying ink to an ink jet type recording head, that comprises an ink chamber containing the ink; an ejection opening formed through a bottom of the ink chamber, to eject the ink from the ink chamber toward the recording head; and a residual ink ejecting mechanism disposed in the ink chamber, the residual ink ejecting mechanism comprising a liquid send-out member movable between a standby position and a send-out position, a biasing member for biasing the liquid send-out member toward the send-out position, and a lock member movable between a lock position for locking the liquid send-out member in the standby position against a biasing force of the biasing member, and an unlock position allowing the liquid send-out member to move to the send-out position, wherein the liquid send-out member pushes out a residue of the ink, which remains on the bottom of the ink chamber, toward the ejection opening, while moving to the send-out position.

Where the ink chamber is partitioned by a partition wall into an ink absorbent chamber containing an ink absorbent that absorbs and holds the ink by a capillary force, and a storage chamber storing the ink, and the ink absorbent absorbs the ink from the storage chamber through an interconnection slot formed through the partition wall in a portion near the bottom of the ink chamber, the ejection opening is formed through the ink absorbent chamber, and the residual ink ejecting mechanism is disposed in the storage chamber such that the liquid send-out member sends out the residual ink toward the interconnection slot.

According to a preferred embodiment, the lock member is displaced to the unlock position by an unlock device that is disposed outside the ink chamber.

An ink-jet recording apparatus for use with the ink tank of the present invention comprises a sensor for checking if the ink tank runs out of the ink, and an unlock device that acts on the lock member of the ink tank, to displace the lock member to the unlock position when the sensor detects that the ink tank is running out of the ink.

Because the liquid send-out member pushes out the residual ink from the ink chamber toward the ejection opening, while moving to the send-out position, the final amount of the residual ink is reduced to the minimum, without the need for reducing the capacity of the ink chamber.

BRIEF DESCRIPTION OF THE DRAWINGS

The above and other objects and advantages will be more apparent from the following detailed description of the preferred embodiments when read in connection with the accompanied drawings, wherein like reference numerals designate like or corresponding parts throughout the several views, and wherein.

DESCRIPTION OF THE PREFERRED EMBODIMENTS

Figure 1:
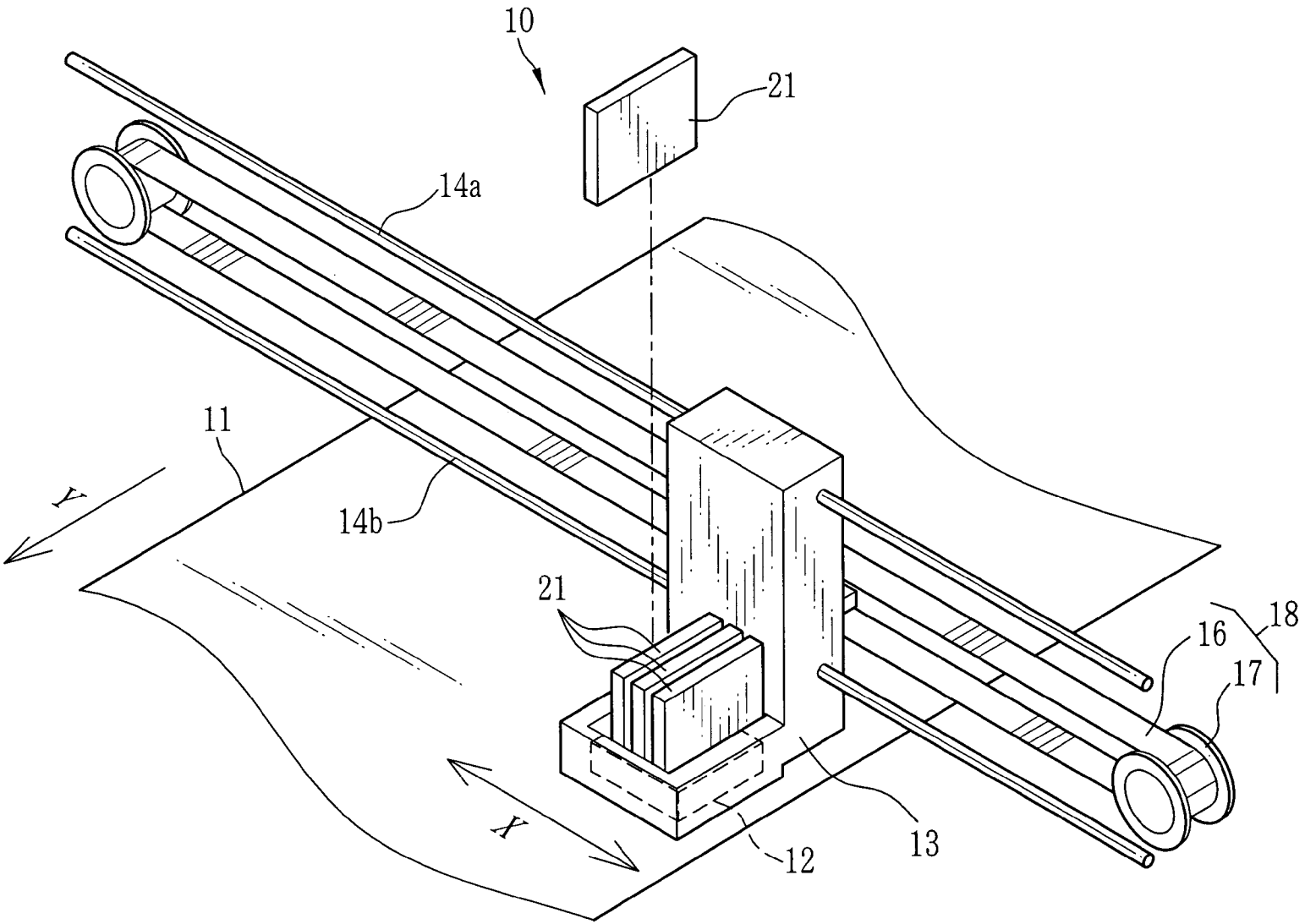
FIG. 1 is an explanatory diagram illustrating essential elements of an ink-jet recording apparatus according to an embodiment of the invention.

An ink-jet recording apparatus 10 shown in FIG. 1 is provided with a recording head 12 that discharges ink toward a paper sheet 11 to print images thereon. The recording head 12 is provided with a plurality of not-shown nozzles for discharging the ink from individual outlets. The outlets of the nozzles are aligned in a plane to form a discharging surface, and the discharging surface is placed in face to a recording surface of the paper sheet 11. The recording head 12 is mounted in a carriage 13 that is movable in a widthwise direction of the paper sheet 11, that is, a main scanning direction X. The discharging surface is exposed through an opening formed through a bottom of the carriage 13. While reciprocating in the widthwise direction of the paper sheet 11 together with the carriage 13, the recording head 12 records an image in a line sequential fashion. Each time the recording head 12 makes one lap to record a line of the image, the paper sheet 11 is fed by not-shown conveyer rollers in a sub scanning direction Y, that is orthogonal to the main scanning direction X, by a length corresponding to a width of each image line as recorded by the recording head 12. Thus, the image is recorded line by line.

The carriage 13 is mounted on a pair of guide rods 14*a* and 14*b* to slide thereon, and is driven by a belt mechanism 18 consisting of a belt 16 and a pair of pulleys 17. The carriage 13 carries ink cartridges 21, e.g. four cartridges containing inks of four different colors: yellow, magenta, cyan and black.

The carriage 13 is provided with not-shown slots, into which the ink cartridge 21 is plugged. In each slot, there is provided an ink supply needle 36, see FIG. 2, having a through-hole as a path for supplying the ink to the recording head 12. When the ink cartridge 21 is plugged in the slot, the ink supply needle 36 is stuck into an ink outlet 31 that is formed on a bottom of the ink cartridge 21, so the ink contained in the ink cartridge 21 is supplied through the ink supply nozzle 36 to the recording head 12. In the recording head 12, not-shown pressure rooms and oscillation plates are provided in one-to-one relationship with the nozzles. The oscillation plates are driven individually by piezoelectric elements, to change volume of the pressure room. Thereby, the ink in the ink cartridge 21 is sucked into the nozzle, and is ejected from the outlet of the nozzle.

Figure 2:
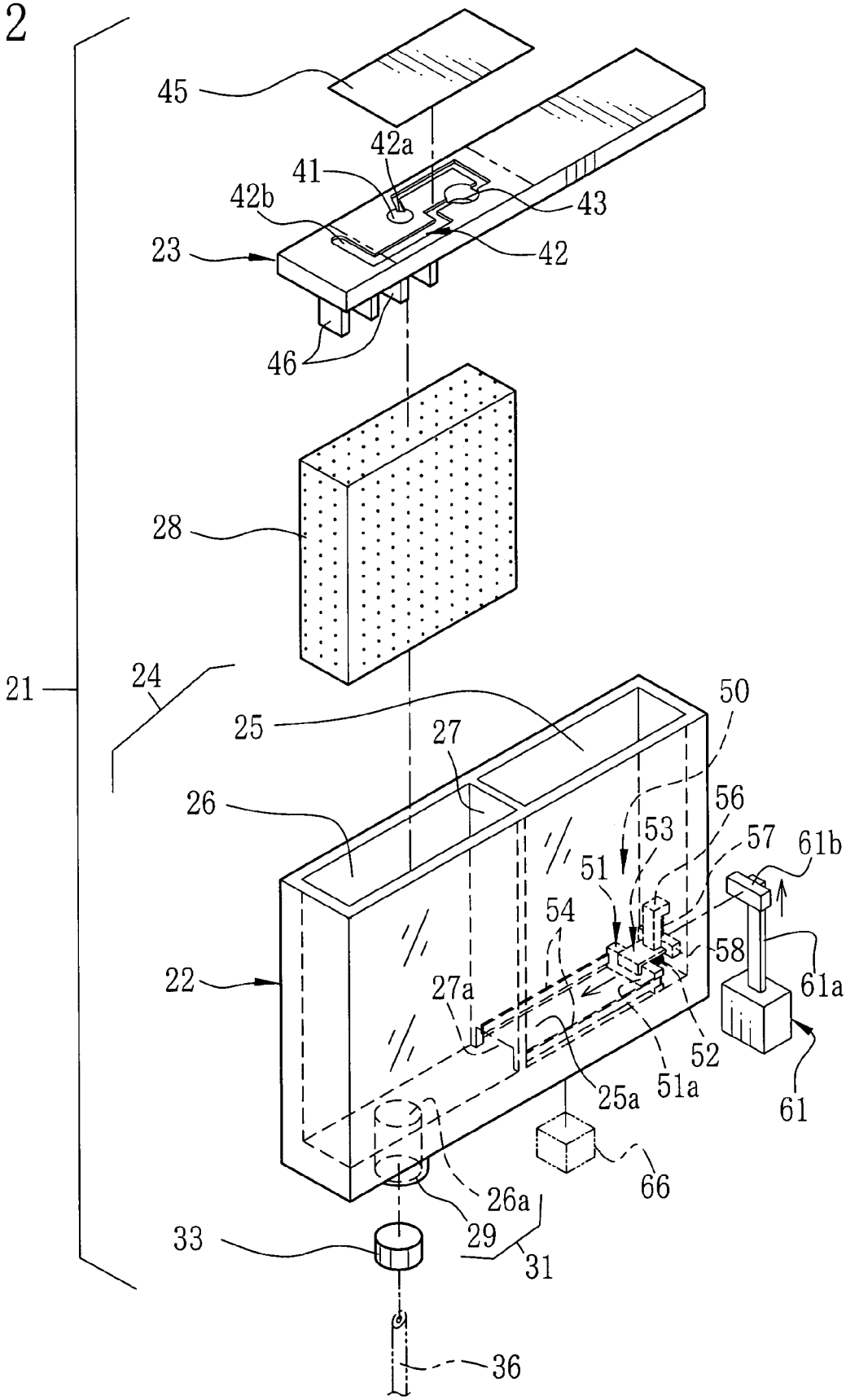
FIG. 2 is an exploded perspective view of an ink cartridge used in the ink-jet recording apparatus of FIG. 1.

As shown in FIG. 2, the ink cartridge 21 consists of a case body 22 formed with ink chambers 24 for storing the ink, and a lid 23 for closing an open top of the case body 22. The lid 23 is affixed to the case body 22, for example, by welding, after the case body 22 is filled with the ink. Thereby, the ink is prevented from leaking through the open top of the case body 22. The case body 22 is formed from a transparent plastic or the like, so the remaining amount of the ink in the ink cartridge 21 is visible from outside.

The ink chamber 24 is partitioned into an ink absorbent chamber 26 holding an ink absorbent 28 that absorbs and holds the ink by its capillary force, and a storage chamber 25 for storing the ink. The ink absorbent chamber 26 and the storage chamber 25 are partitioned by a partition wall 27, and are interconnected through an interconnection slot 27*a* formed through the partition wall 27 in a portion near the bottom of the ink chamber 24. Thus, the ink absorbent 28 absorbs the ink from the storage chamber 25 through the slot 27*a*.

An ejection opening 26*a* for ejecting the ink from the ink absorbent chamber 26 out of the case body 22 is formed through a bottom portion of the ink absorbent chamber 26. The ejection opening 26*a* and an ejection tube 29 extending downward from the ejection opening 26*a* constitute an ink outlet 31. A filter 33 for filtering the ink is provided in the ejection tube 29.

The ink absorbent 28 is a spongy material having micro holes that generate the capillary force. Concretely, the ink absorbent 28 is made of a porous material, including a foamed material like urethane foam, or a fibrous material like felt. The filter 33 is a spongy member that generates a capillary force like the ink absorbent 28. A top surface of the filter 33 is in tight contact with a bottom surface of the ink absorbent 28, so that the filter 33 absorbs the ink from the ink absorbent 28 by its capillary force. As the ink cartridge 21 is attached to the carriage 13, the ink absorbent chamber 26 is connected to the recording head 12 that is placed under the carriage 13. More specifically, as the ink cartridge 21 is attached to the carriage 13, the ink supply needle 36 in the slot of the carriage 13 is stuck from the bottom into the filter 33, providing the ink supply path from the ink cartridge 21 through the ink supply needle 36 to the associated nozzle of the recording head 12.

The ink absorbent 28 generates a negative pressure due to its capillarity, which keeps the pressure of the ink in the ink absorbent chamber 26 negative to the atmosphere. Keeping the ink pressure in the ink absorbent chamber 26 negative to the atmosphere makes an ink pressure in the nozzles of the recording head 12 negative to the atmosphere, which forms meniscuses of the ink in the nozzles, preventing leakage of the ink from the nozzles.

For printing, the recording head 12 generates such a suction force against the negative pressure of the ink in the ink absorbent chamber 26, that sucks the ink from the ink absorbent chamber 26 and ejects it from the outlet of the nozzle. As the recording head 12 sucks the ink, the pressure in the ink absorbent chamber 26 decreases, so the air enters the ink absorbent chamber 26 through an air entrance 41 that is formed through the lid 23. The ink contained in the ink chamber 24 is consumed first from the portion in the ink absorbent chamber 26, and the ink is supplied from the storage chamber 25 to the ink absorbent chamber 26 for refill. As the internal pressure of the storage chamber 25 decreases with the ink, the air is taken into the storage chamber 25 through the interconnection slot 27*a*. Repeating the air-liquid exchange as above, the ink is fed to the recording head 12.

The lid 23 has a meander groove 42 formed on its top side. One end 42*a* of the groove 42 is connected to the air entrance 41, and a liquid sink 43 is formed on a path from the end 42*a* to a second end 42*b*. A section of the groove 42 exclusive of the second end 42*a*, i.e. the section between phantom lines in FIG. 2, is covered from the top with a shield 45, so the second end 42*b* alone is exposed to the atmosphere. The groove 42 leads the ink to the liquid sink 43 if the ink leaks out of the ink absorbent chamber 26 through the air entrance 41. So the ink is prevented from leaking out of the ink cartridge 21. The air is introduced from the second end 42*b* into the air entrance 41.

A plurality of ribs 46 are formed on the bottom side of the lid 23 in an area facing to the ink absorbent chamber 26. As the lid 23 is attached to the case body 22, the ribs 46 protrude into the ink absorbent chamber 26 and come into contact with a top side of the ink absorbent 28, pressing down the ink absorbent 28 onto the bottom of the ink absorbent chamber 26. Thereby, the ink absorbent 28 is fixedly positioned to provide a room between the ink absorbent 28 and the lid 23, preventing the ink absorbent 28 from being displaced to close the air entrance 41.

A residual ink ejecting mechanism 50 is built in the storage chamber 25. The residual ink ejecting mechanism 50 wipes off the remaining ink from a bottom surface 25*a* of the storage chamber 25, so that the remaining ink is discharged through the ejection opening 26*a*. The residual ink ejecting mechanism 50 consists of a liquid send-out member 51, a spring 52 and a lock member 53.

Figure 3A:
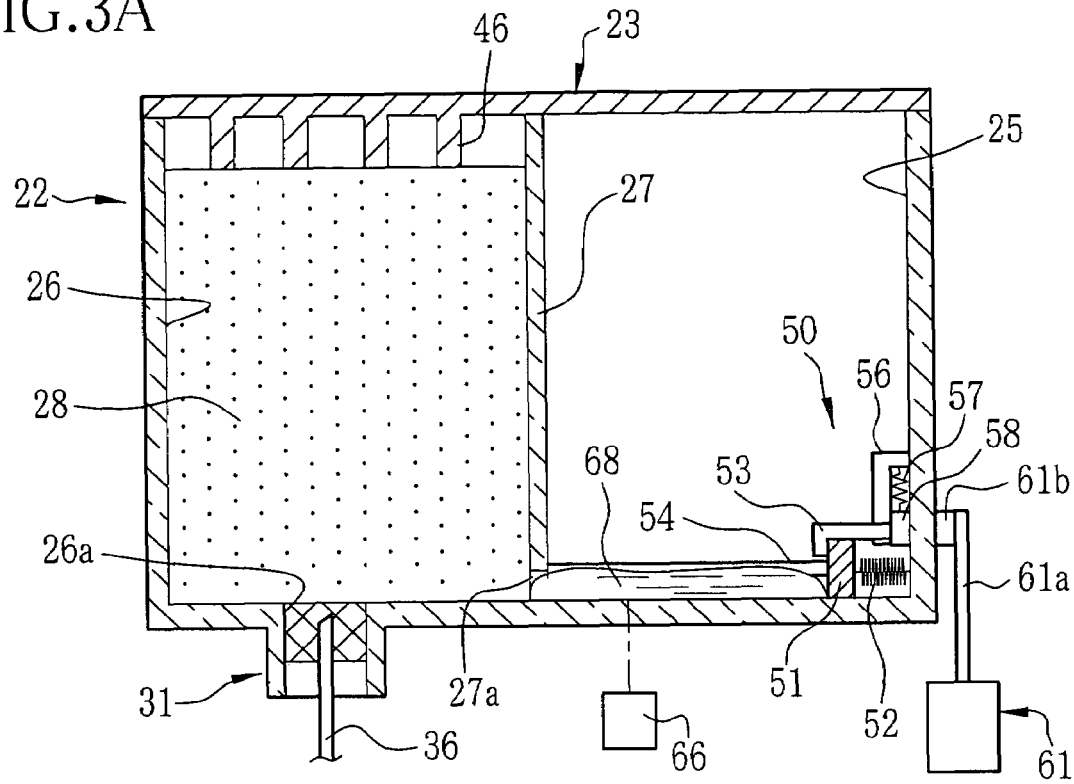
FIGS. 3A and 3B are sectional views of the ink cartridge of FIG. 2, illustrating how a residual ink ejecting mechanism works in the ink cartridge.
Figure 3B:
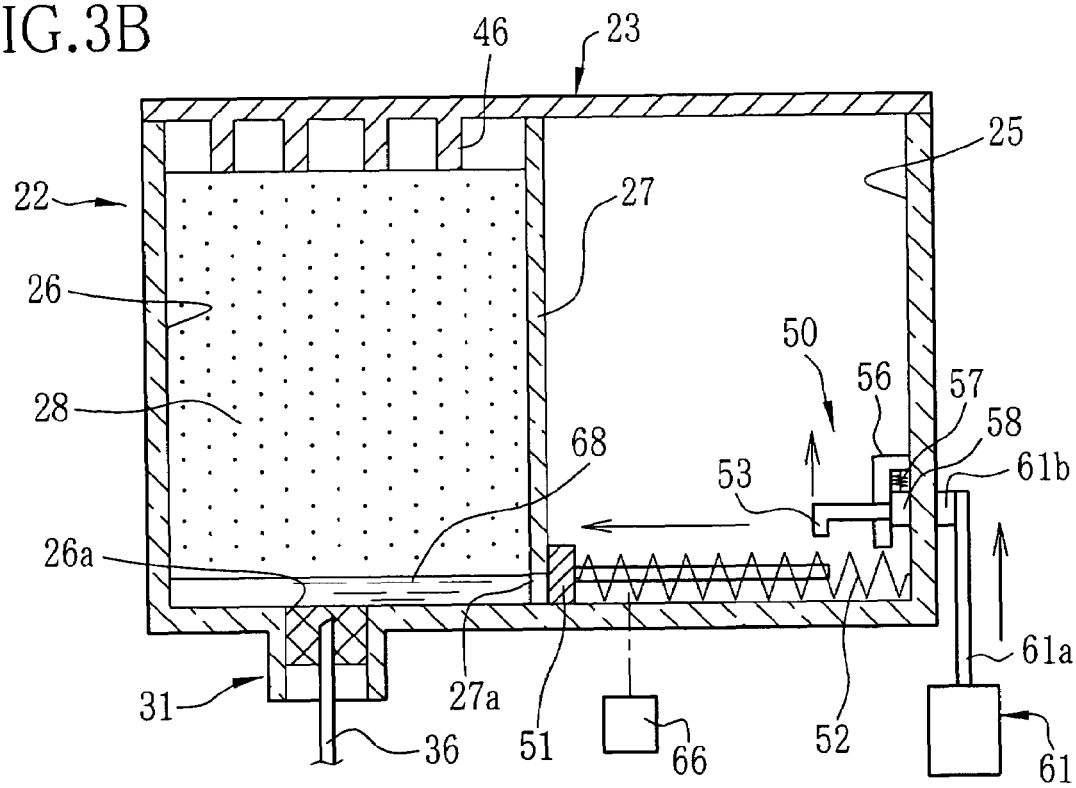

The liquid send-out member 51 is a substantially parallelepiped block, and is mounted movable on the bottom surface 25*a* between a standby position at a corner of the storage chamber 25, as shown in FIG. 3A, and a send-out position, as shown in FIG. 3B, where a front face 51*a* of the liquid send-out member 51 is in contact with the interconnection slot 27*a*. The spring 52 biases the liquid send-out member 51 toward the send-out position. The storage chamber 25 is elongated in the movable direction of the liquid send-out member 51, and has an uniform width throughout the length. The liquid send-out member 51 extends across the width of the storage chamber 25, so opposite side faces of the liquid send-out member 51 are kept in contact with side walls of the storage chamber 25. A pair of guide rails 54 are formed on insides of the side walls of the storage chamber 25, and are engaged with the opposite side faces of the liquid send-out member 51, so that the liquid send-out member 51 is guided along the guide rails 54 while being moved by the biasing force of the spring 52. The guide rails 54 keep the liquid send-out member 51 in contact with the bottom surface 25*a* from the standby position to the send-out position, so the liquid send-out member 51 slides on the bottom surface 25*a*. The liquid send-out member 51 is made of rubber or the like. Thus, the liquid send-out member 51 pushes out the residual ink from the storage chamber 25 through the interconnection slot 27*a* to the ink absorbent chamber 26. The ink sent to the ink absorbent chamber 26 is absorbed into the ink absorbent 28. The absorbed ink is discharged through the ejection opening 26*a* and supplied to the recording head 12.

In the above embodiment, the ejection opening 26*a* is located on the extension line of the movable direction of the liquid send-out member 51, so the residual ink is sent toward the ejection opening 26*a* as the liquid send-out member 51 moves toward the send-out position. But it is not always necessary to locate the ejection opening 26*a* on the extension line of the movable direction of the liquid send-out member 51.

The lock member 53 locks the liquid send-out member 51 in the standby position against the biasing force of the spring 52. The lock member 53 consists of a flat portion that extends over the liquid send-out member 51 from rear to front of the liquid send-out member 51, and an engaging portion provided on a front end of the flat portion. The lock member 53 is movable between a lock position where the engaging portion is engaged with the front face 51*a* of the liquid send-out member 51 to lock the liquid send-out member 51 in the standby position, and an unlock position upward from the lock position where the lock member 53 is disengaged from the front face 51*a* and thus unlock the liquid send-out member 51. A not-shown notch is formed in a center of a rear end of the lock member 53, and the notch is engaged with a guide member 56, so the lock member 53 is guided up and down along the guide member 56. A spring 57 biases the lock member 53 toward the lock position.

The lock member 53 further has an attracted portion 58 on the rear end, so the lock member 53 is engaged with the guide member 56 by nipping the guide member 56 between the notch in the rear end and the attracted portion 58. The attracted portion 58 cooperates with an unlock device 61 that is mounted to the carriage 13 in the ink-jet recording apparatus 10. The attracted portion 58 and the unlock device 61 constitute an unlock mechanism for the lock member 53.

To unlock the lock member 53, the unlock device 61 makes use of electrostatic attraction due to a coulomb force. The unlock device 61 is provided with a movable rod 61*a* that is placed in opposition to the attracted member 58 and is movable in parallel to the direction of displacement of the lock member 53, and an attracting portion 61*b* that is disposed on an upper end of the movable rod 61*a*. The attracting portion 61*a* generates a force to attract the attracted portion 58 through the side wall of the case body 22. The attracted portion 58 and the attracting portion 61*b* are made of a material that can be statically electrified, for example, a metal. In order to displace the lock member 53 to the unlock position, the unlock device 61 lifts up the movable rod 61*a* while attracting the attracted portion 58 to the attracting portion 61*b* by generating the attracting force electro-statically.

The ink-jet recording apparatus 10 is further provided with an ink run-out sensor 66 for checking if the ink cartridge 21 runs out of the ink, that is, if the ink in the ink cartridge 21 is used up. The ink run-out sensor 66 is placed in a position that faces the bottom of the storage chamber 25 of the ink cartridge 21 as being set in the carriage 13. For example, the ink run-out sensor 66 is a reflective photo sensor that consists of a light emitter emitting a light beam toward the storage chamber 25 and a light receiver receiving a reflected light beam from the storage chamber 25. The ink run-out sensor 66 emits the light toward the bottom of the storage chamber 25, and outputs a signal of a level corresponding to the reflected light whose amount varies with the ink volume in the storage chamber 25. So the ink-jet recording apparatus 10 can determine based on the output level of the signal from the ink run-out sensor 66, as to whether the ink in the storage chamber 25 is used up or not.

Even while it is determined based on the output signal from the ink run-out sensor 66 that the ink is used up, the ink often remains on the bottom surface 25*a* of the storage chamber 25. So the ink-jet recording apparatus 10 activates the unlock device 61 to unlock the lock member 53 upon the ink run-out sensor 66 detecting the run-out of the ink. Thereby the liquid send-out member 51 pushes out the residual ink from the storage chamber 25 into the ink absorbent chamber 26. The ink-jet recording apparatus 10 counts how many times the ink is discharged from the recording head 12 after the residual ink ejecting mechanism 50 is activated to send out the residual ink from the storage chamber 25. Since the residual amount of the ink at the time of detection of run-out by the ink run-out sensor 66 can be determined by experience, it is possible to detect based on the count when the ink is completely used up.

Now the operation of the above embodiment will be described with reference to FIG. 3. As the ink-jet recording apparatus 10 carries out printing, the recording head 12 consumes the ink 68 from the ink cartridge 21 that is set in the carriage 13, so the residual amount of the ink 68 in the ink cartridge 21 decreases. When the ink 68 in the storage chamber 25 is almost used up, the ink run-out sensor 66 outputs an ink run-out detection signal. Upon the ink run-out detection signal, the ink-jet recording apparatus 10 activates the unlock device 61 to unlock the liquid send-out member 51. Then, the liquid send-out member 51 moves from the standby position to the send-out position according to the biasing force of the spring 52, wiping off the ink 68, which remains on the bottom surface 25*a* of the storage chamber 25, by pushing the residual ink into the ink absorbent chamber 26. Thereafter, the ink-jet recording apparatus 10 counts the number of times of discharging of the ink from the nozzle, while continuing printing. When the count reaches a predetermined value, the ink-jet recording apparatus 10 judges that the ink 68 is completely used up, and notifies the user of the necessity for changing the ink cartridge 21.

The residual ink ejecting mechanism of the ink cartridge may be modified in many ways. For example, as shown in FIG. 4, a residual ink ejecting mechanism 71 may have a lock member 72 that rotates from a lock position to an unlock position, although the residual ink ejecting mechanism 50 of the above embodiment unlocks the liquid send-out member 51 by moving the lock member 50 upward in parallel to the vertical direction.

Figure 4A:
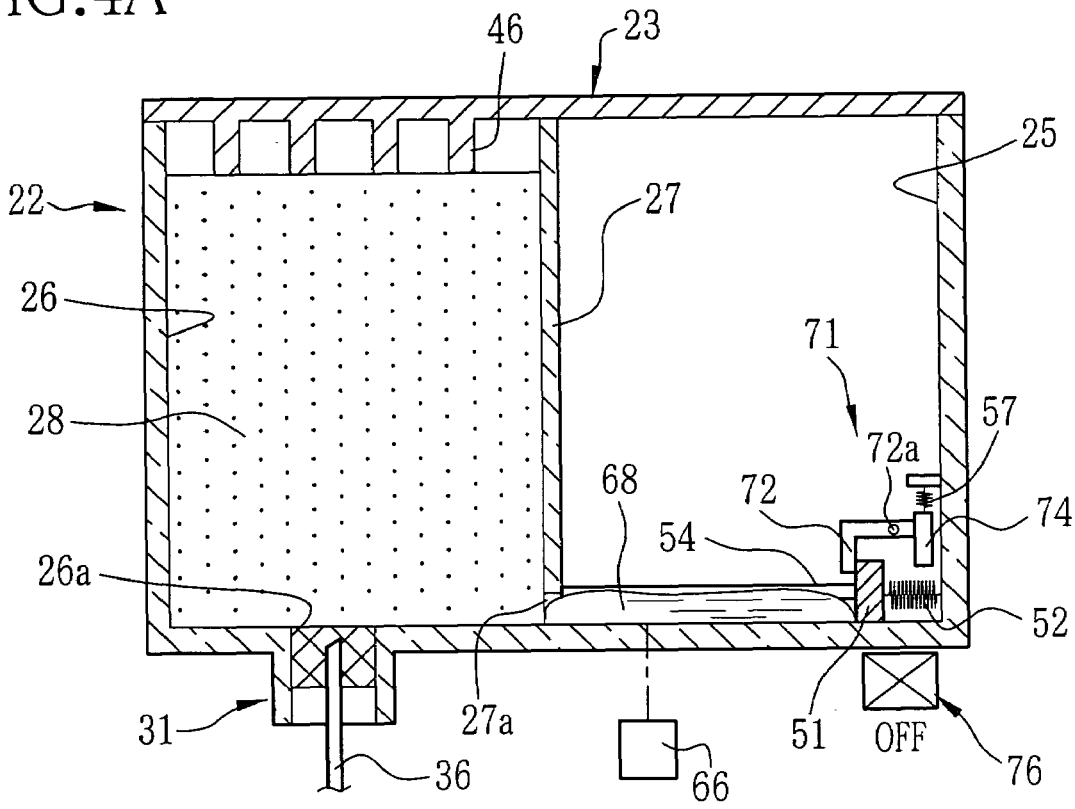
FIGS. 4A and 4B are sectional views of an ink cartridge having a residual ink ejecting mechanism according to another embodiment of the invention.

The lock member 72 is mounted pivotal about an axis 72*a*, between a lock position locking a liquid send-out member 51, as shown in FIG. 4A, and an unlock position as shown in FIG.

Figure 4B:
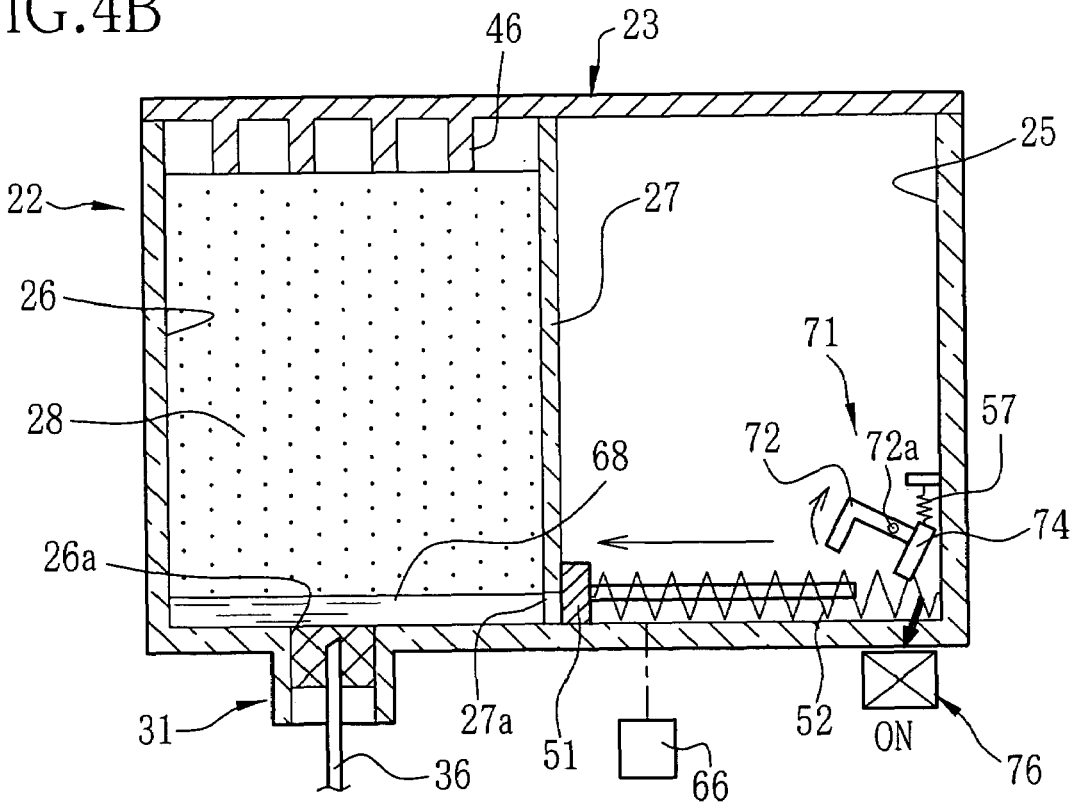

4B. The lock member 72 is biased toward the lock position by a spring 57. An attracted portion 74 is attached to the lock member 72. The attracted portion 74 is made of a metal or the like that is magnetically attracted. An unlock device 76 is provided with an electromagnet, which is kept off unless an ink run-out sensor 66 outputs an ink run-out detection signal, so the lock member 72 is kept in the lock position according the biasing force of the spring 57, as shown in FIG. 4A. When the ink run-out sensor 66 outputs the ink run-out detection signal, the electromagnet is turned on attracting the attracted portion 74 to it against the biasing force of the spring 57, as shown in FIG. 4B. As a result, the lock member 72 is displaced to the unlock position, releasing the liquid send-out member 51.

Figure 5:
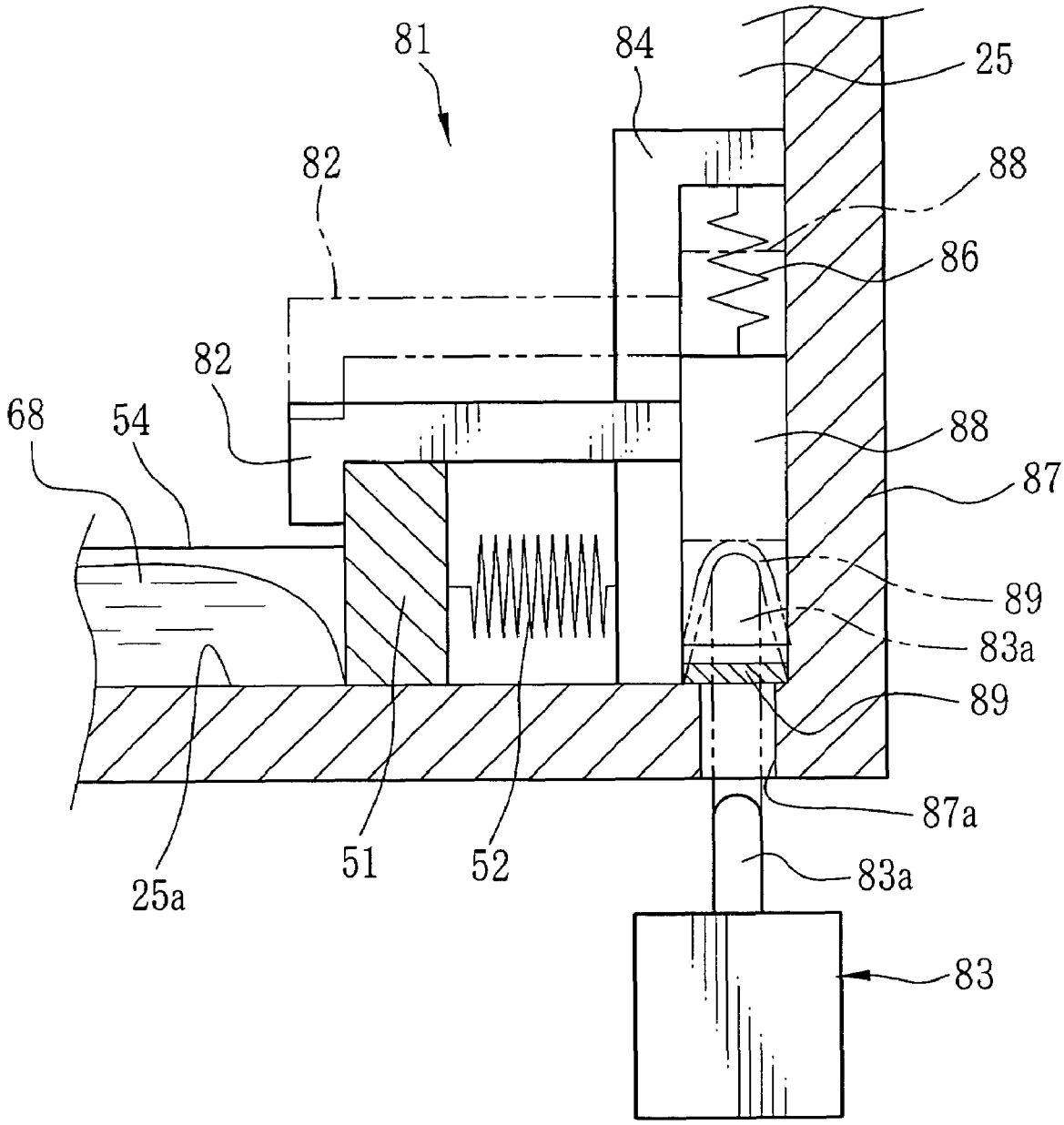
FIG. 5 is a fragmentary sectional view of a residual ink ejecting mechanism of an ink cartridge according to a further embodiment of the invention.

Alternatively, as a residual ink ejecting mechanism 81 shows in FIG. 5, an unlock device 83 pushes a lock member 82 to an unlock position unlocking a liquid send-out member 51. The lock member 82 is movable vertically from a lock position, as shown by slid lines, upward to an unlock position, as shown by phantom lines, while being guided along a guide rod 84, like the lock member 53 of the first embodiment. The lock member 82 is biased toward the lock position by a spring 86.

The unlock device 83 has a pushing member 83*a* that is movable up and down. An opening 87*a* is formed through a bottom of a case body 87 of an ink cartridge, so the pushing member 83*a* may protrudes into a storage chamber 25 of the ink cartridge through the opening 87*a*. The lock member 82 is provided with a pushed portion 88 at its rear end, and the pushing member 83*a* comes into contact with the pushed portion 88, to pushes the lock member 82 upward. The opening 87*a* is covered with an elastic film 89, to prevent the ink from leaking out of the storage chamber 25 through the opening 87*a*. The pushing member 83*a* protrudes into the storage chamber 25 while deforming the elastic film 89 as shown by phantom lines, to push up the pushed portion 88 through the elastic film 89.

Note that the pushing member 83*a* is moved into the storage chamber 25 when an ink run-out sensor 66 detects that the ink is running out, that is, when the residual ink in the storage chamber 25 is so small. Therefore, the ink can scarcely leak out even if the opening 87*a* is opened after the pushing member 83*a* is moved in. So it is possible to use an inelastic film for covering the opening 87*a*, insofar as the film is water-tight enough to prevent the ink leakage. In that case, the pushing member 83*a* breaks through the film into the storage chamber 25.

Although the ink-jet recording apparatus of the above described embodiments is provided with the unlock device that automatically unlocks the residual ink ejecting mechanism to send out the residual ink from the storage chamber, it is possible to unlock the residual ink ejecting mechanism manually.

Although the ink cartridge is placed above the recording head in the above embodiment, the present invention is applicable to a case where an ink cartridge is placed below a recording head. In that case, the water head difference keeps the recording head in a negative pressure relative to the atmosphere, so the ink leakage from the nozzle is prevented without a negative pressure generating device. Therefore, it is unnecessary to provide the ink cartridge with an ink absorbent as the negative pressure generating device. So the ink cartridge may have only a storage chamber, wherein an ejection opening is formed through the storage chamber, and a liquid send-out member sends out the residual ink toward the ejection opening of the storage chamber.

Although the ink tank of the present invention has been described with respect to the ink cartridges that are formed separately from the recording head and removably attachable to the recording head, the present invention is applicable to an ink tank that is formed integrally with a recording head.

Thus the present invention is not to be limited to the above-described embodiments, but various modifications will be possible without departing from the scope of claims as appended hereto.

What is claimed is:

1. An ink tank for supplying ink to an ink jet type recording head, comprising:

an ink chamber containing the ink;

an ejection opening formed through a bottom of said ink chamber, to eject the ink from said ink chamber toward said recording head; and a residual ink ejecting mechanism disposed in said ink chamber, said residual ink ejecting mechanism comprising a liquid send-out member movable between a standby position and a send-out position, a biasing member for biasing said liquid send-out member toward said send-out position, and a lock member movable between a lock position for locking said liquid send-out member in said standby position against a biasing force of said biasing member, and an unlock position allowing said liquid send-out member to move to said send-out position, wherein said liquid send-out member pushes out a residue of the ink, which remains on the bottom of said ink chamber, toward said ejection opening, while moving to said send-out position.

2. An ink tank as claimed in claim 1, wherein said ink chamber is partitioned by a partition wall into an ink absorbent chamber containing an ink absorbent that absorbs and holds the ink by a capillary force, and a storage chamber storing the ink, said ink absorbent absorbing the ink from said storage chamber through an interconnection slot formed through said partition wall in a portion near the bottom of said ink chamber, and wherein said ejection opening is formed through said ink absorbent chamber, and said residual ink ejecting mechanism is disposed in said storage chamber such that said liquid send-out member sends out the residual ink toward said interconnection slot.

3. An ink tank as claimed in claim 1, wherein said lock member is displaced to said unlock position by an unlock device that is disposed outside said ink chamber.

4. An ink tank as claimed in claim 3, wherein said lock member is displaced to said unlock position by electrostatic attraction of said unlock device.

5. An ink tank as claimed in claim 3, wherein said lock member is displaced to said unlock position by magnetic attraction of said unlock device.

6. An ink tank as claimed in claim 3, wherein said unlock device comprises a pushing member for pushing said lock member to said unlock position, and said ink chamber is formed with an opening through which said pushing member moves into said ink chamber to push said lock member.

7. An ink tank as claimed in claim 6, wherein said opening is covered with an elastic film, so said lock member is pushed by said pushing member through said elastic film.

8. An ink-jet recording apparatus for recording an image on a recording medium by use of an ink jet type recording head, wherein an ink tank for supplying ink to said recording head comprises an ink chamber containing the ink; an ejection opening formed through a bottom of said ink chamber, to eject the ink from said ink chamber toward said recording head; and a residual ink ejecting mechanism disposed in said ink chamber, said residual ink ejecting mechanism comprising a liquid send-out member movable between a standby position and a send-out position, a biasing member for biasing said liquid send-out member toward said send-out position, and a lock member movable between a lock position for locking said liquid send-out member in said standby position against a biasing force of said biasing member, and an unlock position allowing said liquid send-out member to move to said send-out position, wherein said liquid send-out member pushes a residue of the ink, which remains on the bottom of said ink chamber, toward said ejection opening, while moving to said send-out position.

9. An ink-jet recording apparatus as claimed in claim 8, comprising a sensor for checking if said ink tank runs out of the ink, and an unlock device that acts on said lock member to displace it to said unlock position when said sensor detects that said ink tank is running out of the ink.

10. An ink-jet recording apparatus as claimed in claim 9, wherein said unlock device displaces said lock member to said unlock position by electrostatic attraction.

11. An ink-jet recording apparatus as claimed in claim 9, wherein said unlock device displaces said lock member to said unlock position by magnetic attraction.

12. An ink-jet recording apparatus as claimed in claim 9, wherein said unlock device comprises a pushing member that moves into said ink chamber to push said lock member to said unlock position when said sensor detects that said ink tank is running out of the ink, and said ink chamber is formed with an opening through which said pushing member moves into said ink chamber to push said lock member.

* * * * *